US005557902A

United States Patent [19]

Witmyer

[11] Patent Number: 5,557,902

[45] Date of Patent: Sep. 24, 1996

[54] MICRO CORNICE UNIVERSAL ATTACHMENT CLIP

[75] Inventor: Brian E. Witmyer, Lititz, Pa.

[73] Assignee: Armstrong World Industries, Inc., Lancaster, Pa.

[21] Appl. No.: 402,623

[22] Filed: Mar. 13, 1995

[51] Int. Cl.[6] ..... E04B 5/52

[52] U.S. Cl. ..... 52/506.07; 52/665; 52/39; 248/317; 248/343

[58] Field of Search ..... 52/506.06–506.08, 52/714, 713, 39, 665; 248/343, 344, 223.4, 317

[56] References Cited

U.S. PATENT DOCUMENTS

| | | | |
|---|---|---|---|
| 3,599,921 | 1/1970 | Cumber | 248/317 |
| 3,903,671 | 9/1975 | Cuin et al. | 52/506.06 |
| 4,191,352 | 3/1980 | Schuplin | 248/317 |
| 4,483,116 | 11/1984 | Gailey | 52/506.08 |
| 4,494,346 | 1/1985 | Gailey | 52/665 X |
| 4,564,165 | 1/1986 | Grant et al. | 248/343 |
| 4,845,912 | 7/1989 | Baker | 52/506.09 |
| 4,908,915 | 3/1990 | Ruggles et al. | 52/665 X |
| 5,335,890 | 8/1994 | Pryor et al. | 248/343 |
| 6,490,957 | 1/1985 | Bumpus et al. | 52/506.07 |

*Primary Examiner*—Carl D. Friedman
*Assistant Examiner*—Winnie Yip

[57] ABSTRACT

The universal attachment clip will act as an attachment device for attaching micro cornice trim to each of the major grid systems. The clip will allow attachment and registration of each of the micro cornice trim profiles to 9/16", 15/15", or bolt-slot grid. The registration of the micro cornice profiles to the grid can be at different angular positions.

3 Claims, 2 Drawing Sheets

MICRO CORNICE UNIVERSAL ATTACHMENT CLIP

BACKGROUND OF THE INVENTION

1. Field of the Invention

The invention relates to a connector for a suspended ceiling and, more particularly, to a connector for fastening a decorative cornice to different designs of runners.

2. Description of the Prior Art

U.S. Pat. No. 4,494,346 discloses a ceiling system and panel securing device therefor. Specifically, the system features a device for securing a panel to a stringer at any desired relative angle thereto. Further, a carrier member is grippable in a fixed angular position between the side flanges of the panel and a hanger member, mountable in a fixed angular position on the stringer, for supporting the carrier member beneath the stringer. The stringer is an inverted T-bar having opposed lateral flanges. Ceiling panels are joined to the stringers via a device which comprises a carrier member, grippable between the side flanges of the panel and a hanger member, which mounts on a stringer for supporting the carrier member.

U.S. Pat. No. 4,908,915 discloses various embodiments of a metal clip which is snapped onto a grid system and which anchors it on a metal stud wall system. Specifically, one embodiment features a clip, which has a pair of vertical spaced sides, with a fastening clip located therebetween. The clip has a pair of bent side walls connected by a flat plate and a pair of rivets are used to fasten the upper clip to the fastening portion.

SUMMARY OF THE INVENTION

A connector for ceiling suspension members having a ceiling suspension system comprising at least a first inverted T-runner and a second element fastened to the first runner. The first inverted T-runner has a vertical web member and, at the lower end thereof, horizontal flanges extending on either side of the vertical web. The flanges are capable of being formed of different sizes and shapes. A means connects together the first runner and the second element. The connecting means comprising a) an upper member connected to the first runner, b) a lower member connected to the second element, and c) a middle member connecting together the upper and lower members. The connecting means engages the different sizes and shapes of the flanges depending upon the rotational position of the middle member relative to the flanges.

The web of the runner can be either a 9/16", 15/16" or bolt-slot grid. The bracket of the upper member and grooves of the middle member are designed to receive different flange sizes and shapes. The lower member engages a cornice.

DETAILED DESCRIPTION OF THE INVENTION

A connector for ceiling suspension members has at least a first inverted T-runner and a second element fastened to the first runner. The first inverted T-runner has a vertical web member and, at the lower end thereof, horizontal flanges extending either side of the vertical web, said flanges being capable of being formed of different sizes and shapes. A means connects together the first runner and the second element. The connecting means comprising an upper member connected to the first runner, a lower member connected to the second element, and a middle member connecting together the upper and lower members. The middle member has means to engage the different sizes and shapes of the flanges, depending upon the rotational position of the middle member relative to the flanges.

Figure 1:
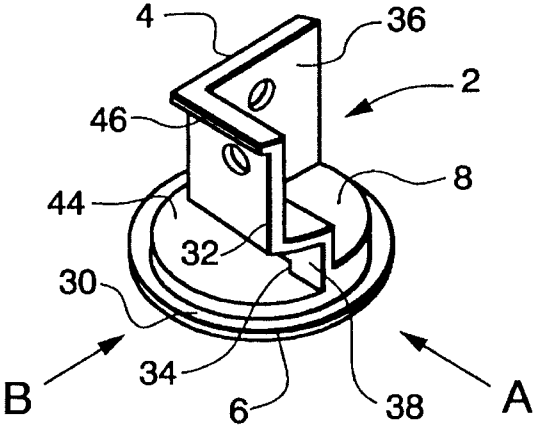
FIG. 1 is a perspective view of the connector.

Connector 2 is shown in FIG. 1. The upper member 4 is connected to the lower member 6 by the middle member 8.

Figure 2:
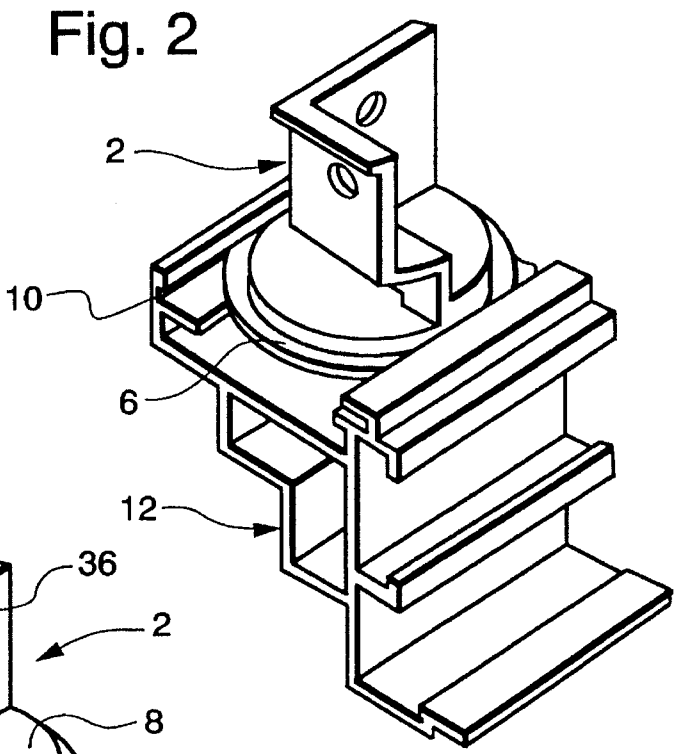
FIG. 2 is a perspective view of the connector engaging the cornice.

In FIG. 2, the lower member 6 is placed in groove 10 of an element 12. Element 12, as shown, is a cornice, i.e., an extruded metal decorative element used as a transition element in a multi-level ceiling system.

Figure 3:
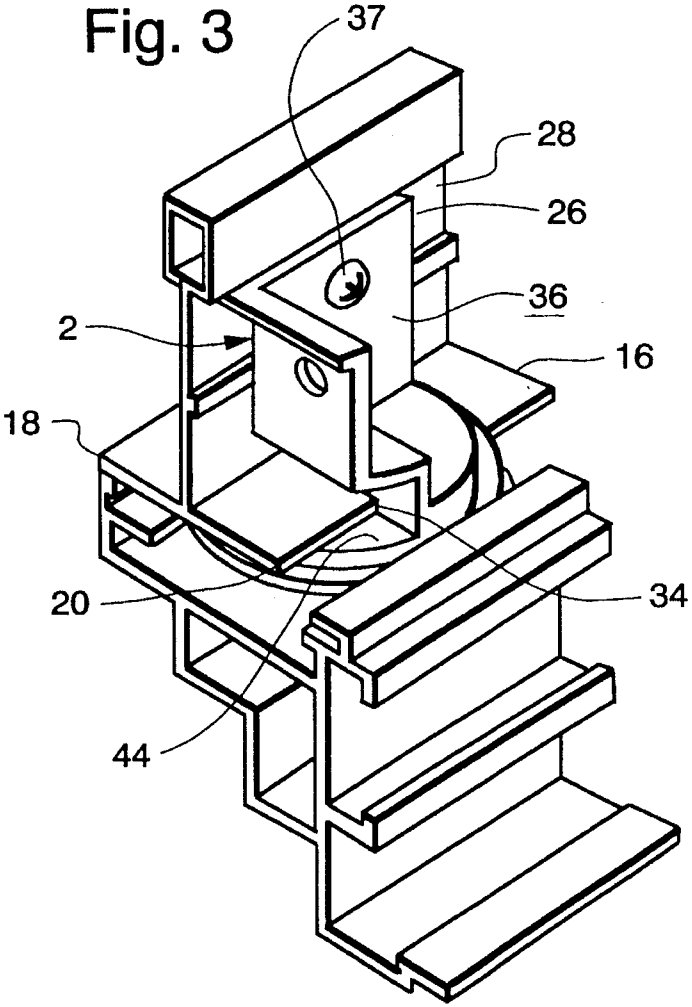
FIGS. 3, 4 and 5 are perspective views of the connector in use.
Figure 5:
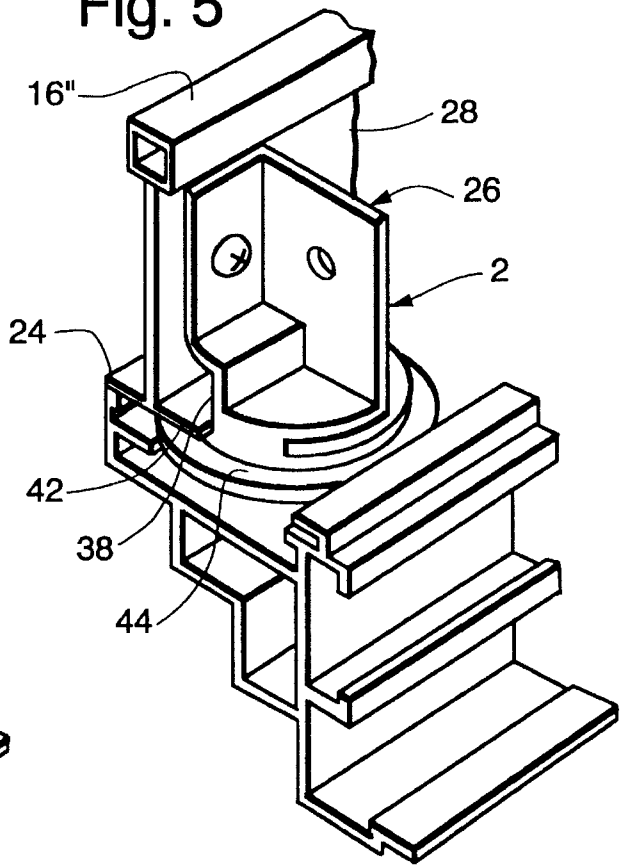
Figure 4:
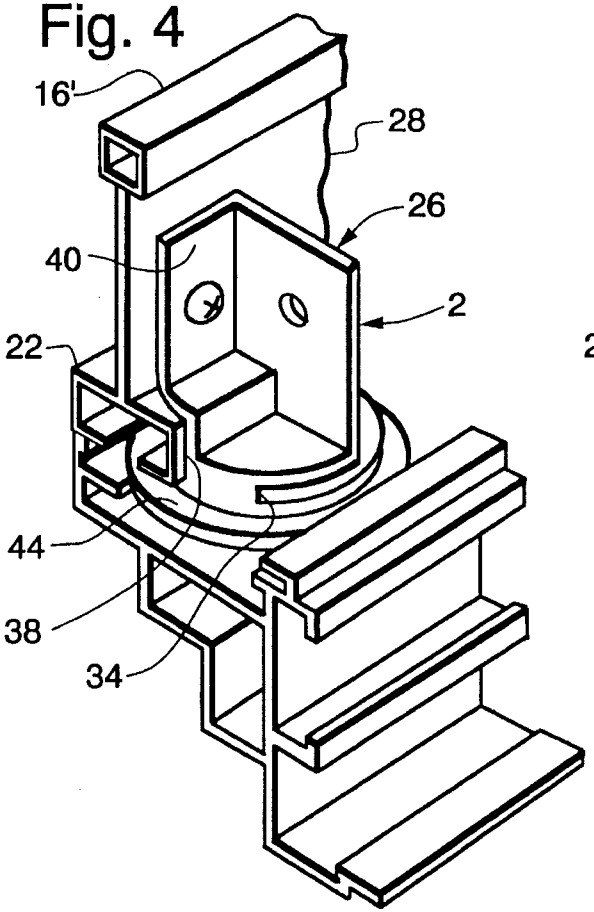

FIG. 3 shows the structure of FIG. 2 being used with a conventional 15/16" ceiling runner having a flange 16, which measures 15/16" from point 18 to point 20. In FIG. 4, the flange 22 is a conventional bolt slot grid having a rectangular shape as shown. In FIG. 5, the flange 24 is the same as flange 16 of FIG. 3, except the flange measures 9/16". In all three embodiments of FIGS. 3–5, the upper member 26 is a right angle bracket, which is fastened to the web 28 of the ceiling runner. The bracket is fastened by appropriate means to the web with an orientation set by the position of the middle member.

Figure 6:
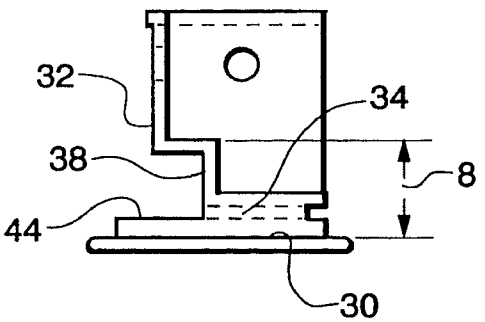
FIG. 6 is a side view of the connector of FIG. 1 from direction A.
Figure 7:
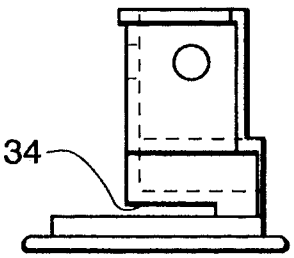
FIG. 7 is a side view of the connector of FIG. 1 from direction B.

Referring to FIGS. 1 and 6, the middle member 8 extends from the top of the lower member 6 at point 30 to the point 32 at the lower end of upper member 4. In FIGS. 1, 6 and 7, a groove 34 exists.

In FIG. 3, the middle member is oriented relative to the runner web 28 so that the part 36 of right angle bracket, i.e., upper member 26, contacts the web 28 of the runner. Groove 34 receives the one side of runner 16 so that the part 36 will be able to be fastened securely to the web by a screw 37 or like means.

In FIG. 4, the connector 2 is rotated 90 degrees clockwise as connector 2 is shown in FIGS. 4 and 5. Groove 34 is not used, but groove 38 now receives the one side of the flange 22 of runner 16' and part 40 of right angle bracket, i.e., upper member 26, engages the web 28 of the runner 16' as shown in FIG. 4.

In FIG. 5, the connector 2 is positioned the same as in FIG. 4, and groove 38 receives one side of the flange 42 of the runner 16". The lower part of the groove 38 is needed for proper placement of part 40 adjacent the web 28 and the height of the groove 38 is not utilized.

The surface 44 at the lower part of the middle member 8 rests against the bottom of the runner flanges to provide stability to the connector when grooves 34 and 38 receive the runner flanges.

The modifications of the above-described structure are of interest. The lower member 6 is formed as a circular disc in order to permit positioning of the cornice at different angles relative to the runner. Member 6 could be made as a polygon (4, 6 sides, etc.) to form a preset, fixed angular relationship.

Another modification is the use of the rib 46 at the top of the upper member 4, as shown in FIG. 1. This modification is shown in FIGS. 1, 2, 3, 6 and 7. It is not used in FIGS. 4 and 5. The rib 46 spaces parts 36 and 40 a slight distance from the runner web 28 to permit the parts 36 and 40 to clear conventional protrusions on the runner web.

What is claimed is:

1. A connector for ceiling suspension members comprising:

a) a ceiling suspension system comprising at least a first inverted T-runner and a second element fastened to the first inverted T-runner;

b) said first inverted T-runner having a vertical web member and, at the lower end thereof, horizontal flanges extending either side of the vertical web, said flanges being capable of being formed of different sizes and shapes; and c) a means connecting together the first inverted T-runner and the second element, said means comprising:

1) an upper member connected to the first inverted T-runner, 2) a lower member connected to the second element, and 3) a middle member connecting together the upper and lower members, said members being rotated as a unit to different positions, said middle member having groove means to receive one of the flanges, and said upper member engaging one side of said vertical web depending upon the different positions of the member rotated relative to the flanges.

2. A connector for ceiling suspension members as set forth in claim 1 wherein:

a) the upper member has a right angle bracket means connected to said first inverted T-runner;

b) the middle member has said groove means to receive one of said flanges of the inverted T-runner flanges; and c) the lower member is a disc-shaped means connected to the second element.

3. A connector for ceiling suspension members as set forth in claim 2 wherein:

a) the bracket means is fastened to the vertical web of the inverted T-runner;

b) the groove means are positioned to receive one of said flanges of the inverted T-runner to permit the bracket means to contact the vertical web; and c) the disc-shaped means is positioned below the runner flanges.

* * * * *